US011591724B2

(12) United States Patent
Myogi et al.

(10) Patent No.: US 11,591,724 B2
(45) Date of Patent: Feb. 28, 2023

(54) LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 43 days.

(21) Appl. No.: 17/333,624

(22) Filed: May 28, 2021

(65) Prior Publication Data

US 2021/0381137 A1 Dec. 9, 2021

(30) Foreign Application Priority Data

Jun. 4, 2020 (JP) ..... JP2020-097688

(51) Int. Cl.

| | |
|---|---|
| ***D03D 51/00*** | (2006.01) |
| ***D03D 49/02*** | (2006.01) |
| ***D03D 47/27*** | (2006.01) |
| ***D03D 51/02*** | (2006.01) |

(52) U.S. Cl.

CPC ..... *D03D 47/275* (2013.01); *D03D 49/02* (2013.01); *D03D 51/02* (2013.01)

(58) Field of Classification Search

CPC ..... D03D 47/275; D03D 49/02; D03D 51/02; D03D 51/00; D03D 49/60; D03D 49/62; D03D 51/007

See application file for complete search history.

(56) References Cited

U.S. PATENT DOCUMENTS

| | | | | |
|---|---|---|---|---|
| 983,550 A * | 2/1911 | Harrington | D03D 47/24 | 139/438 |
| 2,522,629 A * | 9/1950 | Mastriani | D03D 51/28 | 139/357 |
| 2,561,416 A * | 7/1951 | Robinson | D03D 47/44 | 139/432 |
| 2,582,761 A * | 1/1952 | Shertz | D03D 49/24 | 139/145 |
| 2,791,242 A * | 5/1957 | Cashion | D03D 49/70 | 139/303 |

(Continued)

FOREIGN PATENT DOCUMENTS

| | | |
|---|---|---|
| EP | 1245707 A1 | 10/2002 |
| EP | 1600542 A2 | 11/2005 |
| JP | 2004-107838 A | 4/2004 |

OTHER PUBLICATIONS

Oct. 19, 2021, European Search Report issued for related EP Application No. 21176602.7.

*Primary Examiner* — Robert H Muromoto, Jr.

(74) *Attorney, Agent, or Firm* — Paratus Law Group, PLLC

(57) ABSTRACT

A driving-force transmission mechanism includes a driving-force transmission shaft that is provided so as to protrude from a side wall of a side frame while extending parallel to a driving shaft within a space of the side frame and connected to a driving motor, and a gear train that connects the driving-force transmission shaft and a driving shaft.

3 Claims, 2 Drawing Sheets

(56) References Cited

U.S. PATENT DOCUMENTS 2,889,855 A * 6/1959 Turner ..... D03D 51/02 139/336
3,400,423 A * 9/1968 Black, Jr. ..... D03J 1/002 15/312.1
3,441,058 A * 4/1969 Bassing ..... D03D 51/02 139/1 R
3,459,237 A * 8/1969 Xaus ..... D03C 1/144 139/89
3,460,660 A * 8/1969 Barrowclough ..... A47B 81/007 193/27
4,570,683 A * 2/1986 Griffith ..... D03D 47/00 139/194
4,850,399 A * 7/1989 Linka ..... D03D 47/361 139/50
5,007,464 A * 4/1991 Gorris ..... D03D 47/363 66/219
5,259,420 A * 11/1993 Foster ..... D03D 49/06 242/598.5
6,247,503 B1 * 6/2001 Shaw ..... D03D 51/02 139/1 R
2004/0226257 A1 * 11/2004 Jaeger ..... B23Q 1/01 52/749.1
2009/0088035 A1 * 4/2009 Gonzalez ..... B63H 16/12 440/105
2019/0145658 A1 * 5/2019 Hodgkinson ..... B05B 7/22 392/478
2021/0332508 A1 * 10/2021 Myogi ..... D03D 49/02
2021/0381137 A1 * 12/2021 Myogi ..... D03D 47/275
2021/0381138 A1 * 12/2021 Myogi ..... D03D 49/62
2021/0381139 A1 * 12/2021 Myogi ..... D03D 51/06
2022/0098765 A1 * 3/2022 Myogi ..... D03C 9/02
2022/0098766 A1 * 3/2022 Myogi ..... D03D 49/02
2022/0160148 A1 * 5/2022 Tegel ..... A47F 7/0243
2022/0195641 A1 * 6/2022 Porte ..... D03C 13/00

* cited by examiner

LOOM

CROSS-REFERENCE TO RELATED APPLICATION

The present application claims priority from Japanese Patent Application No. 2020-097688, filed on Jun. 4, 2020, the entire subject matter of which is incorporated herein by reference.

BACKGROUND OF THE INVENTION

Field of the Invention

The present invention relates to a loom including a driving motor for driving the loom, a driving shaft which is connected to a swing shaft for driving a reed to swing via a swing mechanism, connected to the driving motor via a driving-force transmission mechanism, and rotationally driven by the driving motor, and a housing-shaped side frame that accommodates the driving shaft and the swing shaft in an orientation in which each axial direction of the driving shaft and the swing shaft matches with a width direction.

Background Art

In a loom, a frame includes a pair of side frames, and the side frames are connected by a plurality of beam materials. Further, the loom includes a driving motor as a main driving source, and is configured to drive the main shaft by the driving motor. The driving motor is provided on one side frame side of the pair of side frames. Each side frame has a housing shape and has a space inside thereof.

A driving shaft to which the main shaft is connected is accommodated within the one side frame. The driving shaft is rotationally driven by the driving motor, so that the main shaft connected to the driving shaft is rotationally driven. The rotation of the driving shaft is also for driving the reed to swing. Specifically, a swing shaft for driving the reed to swing is also accommodated in the one side frame, and the swing shaft is connected to the driving shaft via a swing mechanism such as a cam mechanism and a crank mechanism. As described above, the loom is configured such that the swing shaft is swing-driven as the driving shaft is rotationally driven, whereby the reed is driven to swing.

As described above, the configuration (driving-force transmission mechanism) that connects the driving shaft and the driving motor for rotationally driving the driving shaft by the driving motor is disclosed in JP-A-2004-107838. In the configuration disclosed in JP-A-2004-107838, the driving shaft is provided so as to protrude from an outer side wall of the side frame. Although there is no description in JP-A-2004-107838, the driving motor is provided in a form of being supported by a bracket attached to the side frame or the like on the outside of the side frame which accommodates the driving shaft. The driving motor and the driving shaft are connected by a pulley attached to each of an output shaft of the driving motor and an end of a portion protruding from a side surface of the side frame in the driving shaft, and a timing belt hung on both pulleys.

In the loom, maintenance of a swing mechanism or the like within the side frame may be performed due to aged deterioration, occurrence of a mechanical abnormality, or the like. Also as in the loom disclosed in JP-A-2004-107838, in a general loom, in order to perform the maintenance, the side frame is configured of a frame body which is a main portion and of which at least a part (portion corresponding to the swing mechanism, or the like) of an outer surface is open, and a frame cover capable of being attached or detached to or from the frame body in a form of covering a portion opened as described above. The maintenance is performed after removing the frame cover from the frame body in the side frame.

However, in the loom of the related art, as the pulleys or the like in the loom disclosed in JP-A-2004-107838, a driving-force transmission mechanism for transmitting rotation of the driving motor (output shaft) to the driving shaft is connected to the end of the portion protruding from the side surface of the side frame in the driving shaft. Therefore, as described above, in order to remove the frame cover in the side frame to perform the maintenance, it is necessary to release a connection state between the driving shaft and the driving-force transmission mechanism such as removing the pulleys from the driving shaft.

Therefore, in the maintenance of the loom of the related art, the connection state between the driving shaft and the driving-force transmission mechanism as described above should be released and perform reconnection along with the attachment/detachment of the frame cover, and an operation for the maintenance is complicated as a whole. In a case where the driving-force transmission mechanism is configured of the pulleys and the timing belt as in JP-A-2004-107838, the tension of the timing belt should be readjusted along with the reconnection. In that case, the operation becomes more complicated.

SUMMARY OF THE INVENTION

Therefore, an object of the present invention is to provide a structure of a loom in which an operation can be simplified since release of a connection state between a driving shaft and a driving-force transmission mechanism is not required in performing maintenance.

To achieve the above object, the present invention provides the loom as described above in which the driving-force transmission mechanism includes a driving-force transmission shaft that is provided so as to protrude from a side wall of the side frame while extending parallel to the driving shaft within a space of the side frame and connected to the driving motor, and a gear train that connects the driving-force transmission shaft and the driving shaft.

Further, the loom according to the present invention as described above, the driving-force transmission mechanism may include a driving gear train that is different from the gear train and is provided at a position separated from the side frame in the width direction, and an output shaft of the driving motor and the driving-force transmission shaft may be connected by the driving gear train. Furthermore, a space within the driving box accommodating the driving gear train may be independent of the space of the side frame.

According to the loom according to the present invention, in performing the maintenance, since the release of the connection state between the driving shaft and the driving-force transmission mechanism is not required, it is possible to simplify the operation for the maintenance. Specifically, in the loom according to the present invention, the driving-force transmission mechanism is configured such that the driving-force transmission shaft connected to the driving motor is connected to the driving shaft via the gear train within the side frame. Therefore, the frame cover can be removed without releasing the connection state between the driving shaft and the driving-force transmission mechanism. Therefore, according to the loom of the present invention configured as described above, by disposing the driving motor at an appropriate position, the operation of removing the frame cover, which should be performed for the maintenance, is simplified. As a result, the maintenance can be easily performed.

In such a loom according to the present invention, the connection configuration that connects the driving-force transmission shaft and the output shaft of the driving motor is the gear train (driving gear train), so that the driving-force transmission mechanism configured as described above is advantageous in terms of maintenance. Specifically, as the connection configuration, it is conceivable of a connection configuration that is performed via pulleys and a timing belt. However, in that case, an operation such as adjusting the tension of the timing belt is required. On the other hand, by using the driving gear train as the connection configuration, such an operation is not required. Therefore, according to the configuration, the driving-force transmission mechanism is advantageous in terms of maintenance.

Further, in a case where the connection configuration is the driving gear train, the space within the driving box accommodating the driving gear train is configured to be independent of the space within the side frame. Therefore, lubricating oil that reduces heat generation, wear, or the like of mechanical parts within each space can be freely selected on the driving box side and the side frame side. As a result, the lubricating oil used on the side frame side and the driving box side can be lubricating oil of a type suitable for the mechanical parts accommodated in the respective spaces.

DETAILED DESCRIPTION OF THE INVENTION

Figure 1:
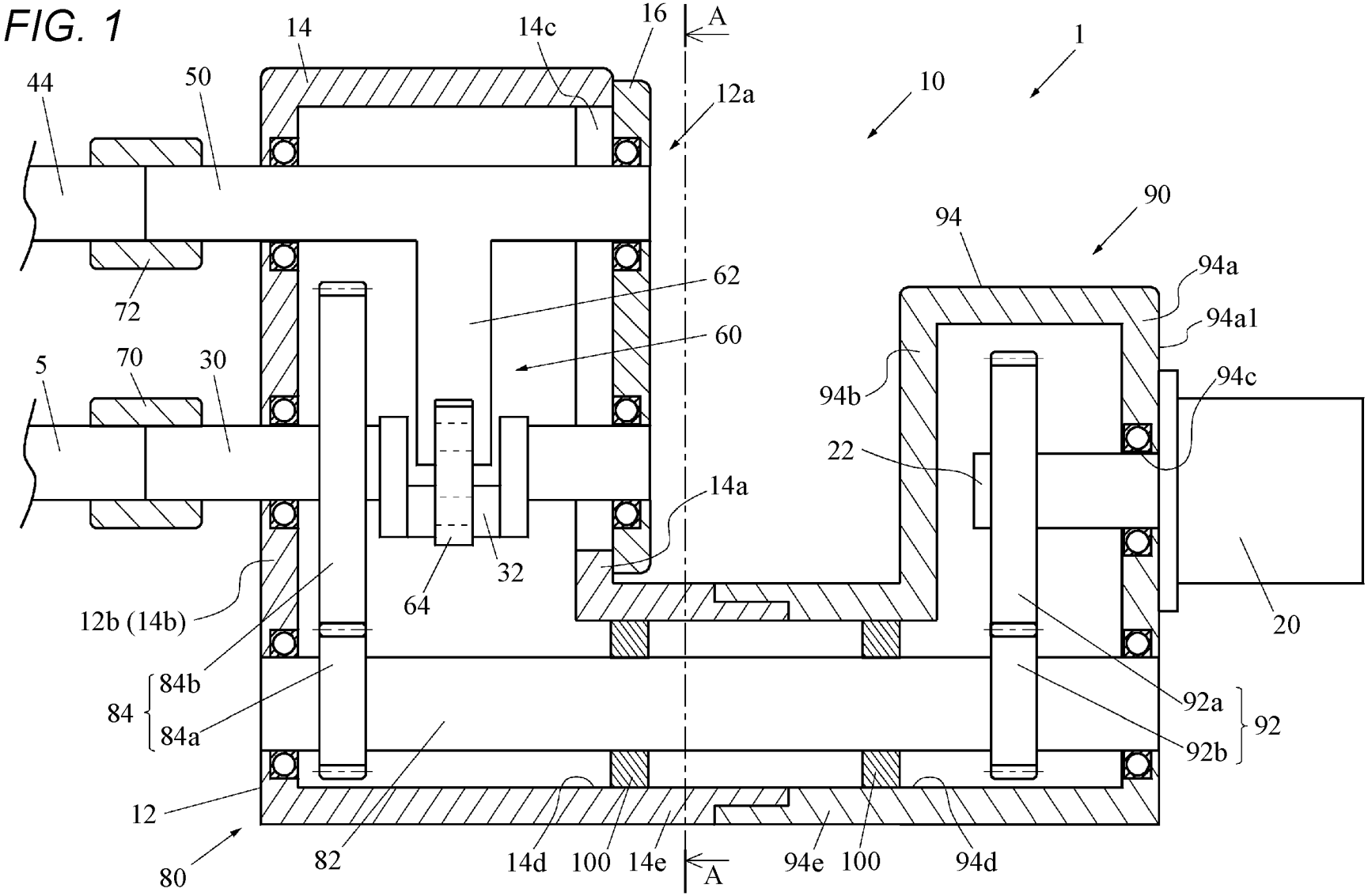
FIG. 1 is a front sectional view of a loom 1 according to an embodiment of the present invention.
Figure 2:
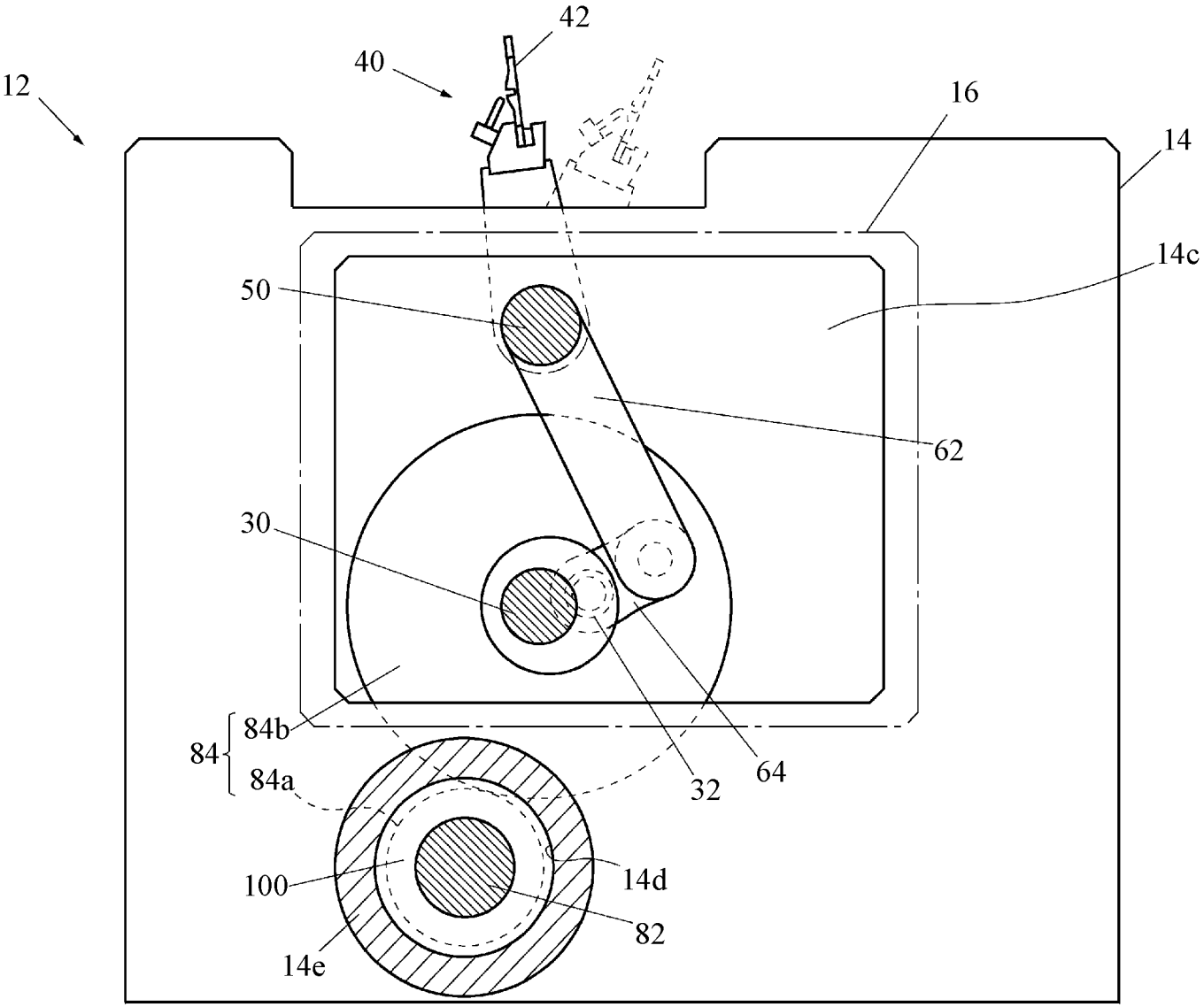
FIG. 2 is a sectional view which is taken along line A-A of FIG. 1.

Hereinafter, an embodiment (example) of a loom to which the present invention is applied will be described with reference to FIGS. 1 and 2.

In a loom 1, a frame 10 includes a pair of housing-shaped side frames 12 and 12, and the side frames 12 are connected by a plurality of beam materials. The loom 1 includes a driving motor 20, and is configured to drive a main shaft 5 of the loom 1 by the driving motor 20. The driving motor 20 is provided on one side frame 12 (hereinafter, referred to as "driving-side frame") side of the pair of side frames 12 and 12.

The driving-side frame 12 is configured of a frame body 14 that is a main portion, and a frame cover 16 attached to the frame body 14. Specifically, the frame body 14 is formed in a housing shape having a space therein, and a portion (portion corresponding to a swing mechanism 60 or the like described later in a width direction) in a side wall (outer wall portion) 14*a*, which is an outside in the width direction of the loom 1, is open. The frame cover 16 is a member formed in a plate shape, and has a size capable of covering an opened portion (opening portion) 14*c* of the frame body 14. The driving-side frame 12 is configured such that the frame cover 16 is attached to the frame body 14 in a form of covering the opening portion 14*c*. Therefore, the side wall (outer wall) 12*a* of the driving-side frame 12 that is the outside in the width direction is configured of the outer wall portion 14*a* of the frame body 14 and the frame cover 16 that covers the opening portion 14*c* thereof. The frame cover 16 is attached to the frame body 14 by using screw members (not illustrated) such as bolts, and the frame cover 16 can be attached or detached to or from the frame body 14.

The loom 1 includes a driving shaft 30 which is interposed between a driving motor 20 and a main shaft 5, is rotationally driven by the driving motor 20, and rotationally drives the main shaft 5. The loom 1 includes a swing shaft 50 for driving a locking shaft 44 to swing in a beating device 40, and a swing mechanism 60 for connecting the swing shaft 50 and the driving shaft 30. The present example is an example in which a crank mechanism is adopted as the swing mechanism 60. The driving shaft 30, the swing shaft 50, and the swing mechanism 60 are disposed to be located within a range of the opening portion 14*c* in the driving-side frame 12 as viewed in the width direction, and are accommodated in the space within the driving-side frame 12. Details of each configuration in such a loom 1 are as follows.

The driving shaft 30 is formed as a shaft having a dimension (length dimension) in an axial direction, which is larger than a dimension of the driving-side frame 12 in the width direction. However, the driving shaft 30 is a crank-shaped shaft formed as an eccentric portion 32 of which an intermediate portion is eccentric with respect to portions of both sides (both-side portions). The driving shaft 30 is rotatably supported by both side walls 12*a* and 12*b* of the driving-side frame 12 via bearings in an orientation in which the axial direction matches with the width direction, and is accommodated in the driving-side frame 12 in such a form.

The support position is located such that the driving shaft 30 is located below an intermediate portion in the opening portion 14*c* in the frame body 14 when the driving-side frame 12 is viewed in the width direction. The driving shaft 30 is supported by the frame cover 16 at one end thereof in one end side. Therefore, the driving shaft 30 is in a state where a portion including the other end is provided in a form of protruding, on the other end side, from an inner wall (inside wall portion) 14*b* of the frame body 14 in the width direction. The driving shaft 30 is supported by the inner wall portion of the frame body 14 at a portion on the driving-side frame 12 side from the protruding portion. The main shaft 5 is connected to the other end of the driving shaft 30 by a coupling member 70.

Similar to the driving shaft 30, the swing shaft 50 is formed as a shaft of which a dimension is larger than the dimension of the driving-side frame 12 in the width direction. Similar to the driving shaft 30, the swing shaft 50 is supported by the both side walls 12*a* and 12*b* of the driving-side frame 12 via bearings in the orientation parallel to the driving shaft 30, and is accommodated in the driving-side frame 12. Similar to the driving shaft 30, the support position is a position within the range of the opening portion 14*c* in the frame body 14 when the driving-side frame 12 is viewed in the width direction, and is a position above the driving shaft 30. The swing shaft 50 is also supported by the frame cover 16 at one end thereof, a portion including the other end is provided so as to protrude from the inner wall portion 14*b* of the frame body 14, and is supported by the inner wall portion 14*b* of the frame body 14 at the other end side thereof. A locking shaft 44 that supports the reed 42 is connected to the other end of the swing shaft 50 by a coupling member 72.

As described above, the swing mechanism 60 is the crank mechanism and includes a swing arm 62 which is provided so as not to rotate relative to the swing shaft 50, and a connection lever 64 which is a link for connecting the swing arm 62 and the eccentric portion 32 of the driving shaft 30.

In the illustrated example, the swing shaft 50 and the swing arm 62 are integrally formed. The connection lever 64 is relatively rotatably connected to the swing arm 62 and the driving shaft 30 (eccentric portion 32). In the swing mechanism 60, the driving shaft 30 is rotationally driven and the eccentric portion 32 is rotationally moved at a position eccentric from a shaft center of both side portions, and thereby the swing arm 62 (swing shaft 50) connected to the eccentric portion 32 via the connection lever 64 is driven to swing. Therefore, in that configuration, a part of the driving shaft 30 also functions as the swing mechanism 60. As described above, the swing shaft 50 is driven to swing, and thereby the locking shaft 44 connected to the swing shaft 50 and the reed 42 supported by the locking shaft 44 move to swing, and the beating operation is performed.

In the loom 1 described above, the loom 1 includes a driving-force transmission mechanism 80 that connects the driving shaft 30 and the driving motor 20. Therefore, the driving shaft 30 connected to the main shaft 5 is rotationally driven by the driving motor 20. In the present invention, the driving-force transmission mechanism 80 is configured to include a driving-force transmission shaft 82 connected to the driving motor 20 and a gear train 84 connecting the driving-force transmission shaft 82 and the driving shaft 30. In the present example, the driving-force transmission mechanism 80 is configured such that the driving-force transmission shaft 82 and the driving motor 20 are connected by a driving gear train 92 different from the gear train 84 within the driving-side frame 12. This is an example in which the driving gear train 92 is accommodated in the driving box 94. Details of the driving-force transmission mechanism 80 of the present example are as follows.

The driving-force transmission shaft 82 is formed as a shaft of which a dimension (length dimension) in the axial direction is larger than the dimension of the driving-side frame 12 in the width direction and is larger than the length dimension of the driving shaft 30. The driving-force transmission shaft 82 is supported by the inner wall 12*b* of the driving-side frame 12 via a bearing at one end thereof in the orientation parallel to the driving shaft 30. However, the support position of the driving-force transmission shaft 82 is a position outside the range of the opening portion 14*c* in the frame body 14, and is a position separated downward from the driving shaft 30. Therefore, the driving-force transmission shaft 82 is in a form provided to penetrate the outer wall portion 14*a* of the frame body 14, and a portion including the other end is located outside the outer wall portion 14*a* of the frame body 14.

In the outer wall portion 14*a* of the frame body 14, a through hole 14*d* is formed at a position corresponding to the support position to allow the driving-force transmission shaft 82 to penetrate as described above. The driving-force transmission shaft 82 is in a state of being provided in a form in which a portion including one end thereof is accommodated in the driving-side frame 12 and a portion including the other end penetrates the through hole 14*d* to protrude from the outer wall portion 14*a* (outer wall 12*a* of the driving-side frame 12) of the frame body 14. The driving-force transmission shaft 82 provided as described above is connected to the driving shaft 30 by the gear train 84 at a portion of one end side thereof within the driving-side frame 12.

The gear train 84 is configured of two gears in the present example. Specifically, the gear train 84 is configured of a driving gear 84*a* attached so as not to rotate relative to the driving-force transmission shaft 82, and a driven gear 84*b* that meshes with the driving gear 84*a* and is attached so as not to rotate relative to the driving shaft 30. The driven gear 84*b* attached to the driving shaft 30, in the present example, is provided on the inner wall 12*b* side in the driving-side frame 12 from the eccentric portion 32 in the driving shaft 30 in the width direction.

The driving-force transmission shaft 82 is a driving mechanism 90 for rotationally driving the driving-force transmission shaft 82 on the other end side, and is connected to the driving mechanism 90 including the driving motor 20. In addition to the driving motor 20, the driving mechanism 90 includes a driving gear train 92 that connects the output shaft 22 of the driving motor 20 and the driving-force transmission shaft 82. The driving mechanism 90 is configured to have a housing-shaped driving box 94 as a base, the driving motor 20 is attached to the outer surface of the driving box 94, and the driving gear train 92 is accommodated within the driving box 94.

In the driving box 94, the driving motor 20 is attached to an outer surface 94*al* of one side wall 94*a* of the pair of side walls 94*a* and 94*b* facing each other, and the both side walls 94*a* and 94*b* are provided to be parallel to the outer wall 12*a* of the driving-side frame 12. The driving box 94 is provided to overlap the driving-side frame 12 in the back and forth direction of the loom 1. As described above, since the driving-force transmission shaft 82 protruding from the driving-side frame 12 is connected to the driving gear train 92 accommodated within the driving box 94, the driving-force transmission shaft 82 penetrates the other side wall 94*b* of the pair of side walls 94*a* and 94*b* in the driving box 94, and the portion of the other end side is located within the driving box 94 (accommodated in the driving box 94). Therefore, a through hole 94*d* that allows the penetration of the driving-force transmission shaft 82 is formed on the other side wall 94*b* in the driving box 94.

As described above, the driving-force transmission shaft 82 protruding from the driving-side frame 12 is supported by one side wall 94*a* in the driving box 94 via a bearing at the other end. However, the driving box 94 is provided such that the other side wall 94*b* through which the driving-force transmission shaft 82 penetrates is separated from the driving-side frame 12.

The driving motor 20 is attached to the driving box 94 by bolts or the like (not illustrated) such that the output shaft 22 is oriented toward the driving-side frame 12 side at a position separated upward with respect to the driving-force transmission shaft 82 supported as described above. A through hole 94*c* is formed on one side wall 94*a* in the driving box 94 to which the driving motor 20 is attached to allow the output shaft 22 of the driving motor 20 to penetrate at the attachment position. Therefore, as described above, in a state where the driving motor 20 is attached to the driving box 94, the output shaft 22 extends within the driving box 94 in the width direction and exists to be parallel to the driving-force transmission shaft 82. The output shaft 22 is connected to a portion of the driving-force transmission shaft 82 on the portion of the other end side of via the driving gear train 92 within the driving box 94.

Similar to the gear train 84 connecting the driving shaft 30 and the driving-force transmission shaft 82, the driving gear train 92 is configured of two gears. Specifically, the driving gear train 92 is configured of a driving gear 92*a* that is attached so as not to rotate relative to the output shaft 22 of the driving motor 20, and a driven gear 92*b* that meshes with the driving gear 92*a* and is attached so as not to rotate relative to the driving-force transmission shaft 82.

In the present example, the frame body 14 has a hollow protruding portion 14*e* formed to protrude from the outer wall portion 14*a* toward the driving box 94 side around the through hole 14*d* in which the driving-force transmission shaft 82 protrudes in the outer wall portion 14*a*, and a space inside the protruding portion 14*e* communicates with the through hole 14*d*. On the other hand, the driving box 94 also has a hollow protruding portion 94*e* formed to protrude from the other side wall 94*b* toward the driving-side frame 12 side around the through hole 94*d* in which the driving-force transmission shaft 82 penetrates in the other side wall 94*b*, and a space inside the protruding portion 94*e* communicates with the through hole 94*d*.

Both the protruding portions 14*e* and 94*e* have each a size (protruding amount) so as to overlap on a protruding end side in the width direction, and are formed to have each a size such that one protruding portions 14*e* (on the driving-side frame 12 side in the illustrated example) fits into the other protruding portion 94*e* (driving box 94 side). Therefore, the through hole 14*d* of the driving-side frame 12 and the through hole 94*d* of the driving box 94 side communicate with each other through the internal spaces of the both protruding portions 14*e* and 94*e*. In other words, in the configuration of the frame 10, the space within the driving-side frame 12 and the space within the driving box 94 are adapted to communicate with each other via the through holes 14*d* and 94*d*, and the spaces within the protruding portions 14*e* and 94*e*. However, in the present example, in the spaces within the protruding portions 14*e* and 94*e*, oil seals 100 are provided between inner peripheral surfaces of the protruding portions 14*e* and 94*e*, and the driving-force transmission shaft 82. A communication state between the space within the driving-side frame 12 and the space within the driving box 94 is blocked by the oil seals 100. In other words, the space within the driving-side frame 12 and the space within the driving box 94 are in a state independent of each other.

According to the loom 1 of the present example configured as described above, the driving-force transmission shaft 82 in the driving-force transmission mechanism 80, which transmits the rotation of the driving motor 20 (output shaft 22) to the main shaft 5, and is connected to the main shaft 5 and rotationally driven by the driving motor 20, is configured such that the one end side portion is accommodated in the driving-side frame 12 and connected to the driving shaft 30 within the driving-side frame 12. Moreover, the position where the driving-force transmission shaft 82 is provided in the driving-side frame 12 is outside the range of the opening portion 14*c* in the frame body 14 to which the frame cover 16 is attached. The driving motor 20 is provided on the side surface (outer surface 94*al*) not facing the frame cover 16 in the driving box 94 that is separated from the driving-side frame 12. That is, the driving motor 20 is provided at a position separated from the driving-side frame 12 so as not to hinder the removal of the frame cover 16.

Therefore, in the loom 1 configured as described above, the frame cover 16 can be removed from the frame body 14 in the driving-side frame 12 while maintaining the connection state between the driving shaft 30 and the driving-force transmission shaft 82 (driving-force transmission mechanism 80). Therefore, in performing maintenance of the swing mechanism 60 or the like within the driving-side frame 12, the removing operation of the frame cover 16 is simplified as compared with that of the loom of the related art. As a result, it is possible to easily perform the maintenance.

In the present example, the driving-force transmission shaft 82 is provided between the driving-side frame 12 and the driving box 94. In a case of such a configuration, it is preferable that the portion in the driving-force transmission shaft 82 between the driving-side frame 12 and the driving box 94 is covered. In the present example, the loom 1 is configured such that the protruding portions 14*e* and 94*e* through which the through holes 14*d* and 94*d* communicate with each other are formed in the driving-side frame 12 and the driving box 94, and both the protruding portions 14*e* and 94*e* are connected to cover the driving-force transmission shaft 82. That is, a configuration is adopted in which the driving-force transmission shaft 82 is covered by the driving-side frame 12 and the driving box 94 itself. Therefore, the configuration that covers the driving-force transmission shaft 82 is realized without increasing the number of parts.

As described above, in a case where the driving-side frame 12 and the driving box 94 are configured to be connected via the protruding portions 14*e* and 94*e*, a form is provided in which the space within the driving-side frame 12 and the space within the driving box 94 communicate with each other. However, in the present example, the oil seals 100 are provided inside the protruding portions 14*e* and 94*e*, and the communication between the both spaces is blocked by the oil seals 100. Therefore, since the both spaces are in an independent state, for example, lubricating oil for driving the gear trains 84 and 92 with lubrication, which are disposed within the respective spaces, can be of a type suitable for the gear trains 84 and 92.

In the above, one embodiment (hereinafter, referred to as "the above example") of the loom to which the present invention is applied is described. However, the present invention is not limited to the configuration described in the above example, and can be implemented in other embodiments (modified examples) as described below.

(1) Regarding the driving-force transmission mechanism, the above example is an example in which the driving-force transmission mechanism 80 is configured such that the driving-force transmission shaft 82 of which the portion on one end side is accommodated in the driving-side frame 12 extends to the driving box 94, and then one (driven gear 92*b*) of gears constituting the driving gear train 92 which is connected to the driving motor 20 is attached to the driving-force transmission shaft 82. Therefore, the driving-force transmission shaft 82 and the driving motor 20 are connected. However, the driving-force transmission mechanism is not limited the configuration described above, and a configuration may be provided in which an intermediate shaft, which is a separated shaft (intermediate shaft) from the driving-force transmission shaft and is connected to the driving motor by the driving gear train, is connected to the driving-force transmission shaft by a coupling member or the like.

In that case, the intermediate shaft is provided in a form in which one end thereof is supported by the one side wall in the driving box. The intermediate shaft is made to protrude from the other side wall in the driving box, and the connection between the intermediate shaft and the driving-force transmission shaft may be performed within the both connected protruding portions of the frame body and the driving box. Alternatively, the driving-force transmission shaft may extend into the driving box through the other side wall in the driving box and the connection may be performed within the driving box.

In the driving-force transmission mechanism, the configuration (connection configuration) in which the driving motor and the driving-force transmission shaft or the intermediate shaft are connected is not limited to the driving gear train 92 configured of two gears of the driving gear 92*a* and the driven gear 92*b* as in the above example. For example, the connection configuration may be one that is also configured of the same gear train, or may be a gear train that is configured of three or more gears. The connection configuration is not limited to one configured of the gear train, and may be configured to connect a pulley attached to the output shaft of the driving motor and a pulley attached to the driving-force transmission shaft with a timing belt.

In a case of the connection configuration using such a timing belt, it is possible to omit the driving box 94 which is different from the driving-side frame 12 as in the above example. In that case, the support of the driving-force transmission shaft on the other end side may be a form in which the portion located on the driving-side frame side from the position where the pulley is attached in the driving-force transmission shaft is supported by the outer wall portion of the frame body. The support of the driving motor may be a form of being performed by, for example, a support bracket or the like attached to the frame body at a position separated from the driving-side frame so that the driving motor does not hinder the removal of the frame cover.

The connection configuration is not limited to the one configured by using the gear train, the timing belt, or the like as described above, and the output shaft of the driving motor and the driving-force transmission shaft may be configured to be directly connected by a coupling member or the like.

(2) Regarding the connection between the driving shaft and the driving-force transmission shaft in the driving-force transmission mechanism, in the above example, the driving shaft 30 and the driving-force transmission shaft 82 are connected by the gear train 84 configured of two gears of the driving gear 84*a* and the driven gear 84*b*. The connection position is on the inner wall 12*b* side of the driving-side frame 12 with respect to the eccentric portion 32 of the driving shaft 30 in the width direction. However, the gear train connecting the driving shaft 30 and the driving-force transmission shaft 82 is not limited to the one configured of two gears as in the above example, and may be configured of three or more gears. The connection position may be on the outer wall 12*a* side of the driving-side frame 12 with respect to the eccentric portion 32 of the driving shaft 30 in the width direction.

(3) Regarding the driving-side frame and the driving box, in the above example, the loom 1 is configured such that the driving-side frame 12 and the driving box 94 are formed of the protruding portions 14*e* and 94*e* as described above, and the portion (shaft portion) of the driving-force transmission shaft 82 (or the intermediate shaft) located between the outer wall 12*a* of the driving-side frame 12 and the other side wall 94*b* of the driving box 94 is covered by the both protruding portions 14*e* and 94*e*. Regarding the protruding portions provided to cover the shaft portion as described above, it is not limited to those formed on both sides of the driving-side frame and the driving box and provided to be connected between the both side walls, and the protruding portions may be formed so as to extend to the other end of only one of the driving-side frame and the driving box and to be connected to the other.

As described above, the protruding portions provided in the driving-side frame and/or the driving box are not limited to be integrally formed with respect to other portions of the driving-side frame or the driving box in which the protruding portions are provided, and may be formed as separate members and attached to a portion of the driving-side frame or the driving box.

The configuration (portion and member) for covering the shaft portion is not limited to those provided as a part of the driving-side frame and/or the driving box, and may be formed as separate members from the driving-side frame and the driving box, and the separate members may be provided independently from each other between the driving-side frame and the driving box. However, in the loom of the present invention, the configuration for covering the shaft portion as described above is not necessarily required, and the loom may be configured such that the shaft portion between the driving-side frame and the driving box may be exposed.

In the above example, as described above, the oil seals 100 are provided inside the protruding portions 14*e* and 94*e* in order to make both spaces independent by blocking the communication state between the space within the driving-side frame 12 and the space within the driving box 94, which are in a state of being capable of communicating with each other by connecting the protruding portions 14*e* and 94*e*. However, in the loom of the present invention, the oil seals can be omitted because the both spaces do not necessarily have to be in an independent state by the configuration or the like.

(4) Regarding the swing mechanism, the above example is an example of the present invention applied to the loom in which the crank mechanism is adopted as the swing mechanism 60. In the above example, the swing arm 62 in the swing mechanism 60 is integrally formed with the swing shaft 50. However, even in the crank mechanism as in the above example, the swing mechanism may be configured such that the swing arm and the swing shaft are formed as separate members, and both are connected so as not to rotate relative to each other. The swing mechanism is not limited to the crank mechanism as in the above example, and may be a cam mechanism. In that case, the shaft to which the cam is attached becomes the driving shaft in the present invention.

Further, the present invention is not limited to the above-described embodiments, and various modifications can be made without departing from the gist of the present invention.

What is claimed is:

1. A loom comprising:

a driving motor for driving the loom;

a driving shaft which is connected to a swing shaft for driving a reed to swing via a swing mechanism, connected to the driving motor via a driving-force transmission mechanism, and rotationally driven by the driving motor; and a housing-shaped side frame that accommodates the driving shaft and the swing shaft in an orientation in which each axial direction of the driving shaft and the swing shaft matches with a width direction, wherein the driving-force transmission mechanism includes a driving-force transmission shaft that is provided so as to protrude from a side wall of the side frame while extending parallel to the driving shaft within a space of the side frame and connected to the driving motor, and a gear train that connects the driving-force transmission shaft and the driving shaft, wherein the loom includes a housing-shaped driving box provided at a position different from the side frame in the width direction, on a side on which the driving-force transmission shaft protrudes with respect to the side frame, and wherein the driving motor is attached to the driving box and is connected to the driving-force transmission shaft or an intermediate shaft connected to the driving-force transmission shaft within a space of the driving box.

2. The loom according to claim 1, wherein the driving-force transmission mechanism includes a driving gear train that is different from the gear train and is provided at a position separated from the side frame in the width direction, and an output shaft of the driving motor and the driving-force transmission shaft are connected by the driving gear train.

3. The loom according to claim 2, wherein a space within a driving box accommodating the driving gear train is independent of the space of the side frame.

* * * * *